United States Patent [19]

Reilly et al.

[11] 4,204,503

[45] May 27, 1980

[54] FLUID DYNAMIC SOOT BLOWER SYSTEM

[76] Inventors: Richard J. Reilly, 1759 Venus Ave., St. Paul, Minn. 55122; John K. Moorhead, 6701 W. Trail, Edina, Minn. 55435

[21] Appl. No.: 910,205

[22] Filed: May 30, 1978

[51] Int. Cl.[2] ..... F22B 37/52

[52] U.S. Cl. ..... 122/392

[58] Field of Search ..... 122/379, 390, 391, 392

[56] References Cited

U.S. PATENT DOCUMENTS 3,269,366 8/1966 Caracristi et al. ..... 122/392

3,273,543 9/1966 Petit ..... 122/392

FOREIGN PATENT DOCUMENTS 288830 4/1928 United Kingdom ..... 122/392

*Primary Examiner*—Edward G. Favors

*Attorney, Agent, or Firm*—Neil B. Schulte

[57] ABSTRACT

A cleaning system for furnace walls in which a cleaning fluid such as air is manifolded through numerous small slots in the furnace wall, exiting adjacent the curved surfaces of the heat exchange tubes. The fluid attaches to and follows the curved tube surfaces to continuously scrub the soot therefrom.

4 Claims, 4 Drawing Figures

FLUID DYNAMIC SOOT BLOWER SYSTEM

BACKGROUND OF THE INVENTION

Probably the most serious and intractable problems associated with the maintenance and operation of furnaces is the continuing necessity to maintain the interior furnace walls free of soot and other accumulated sediments which quickly build up and block the transfer of heat from the fire and combustion gases to the steam pipes in the furnace walls. This is particularly true with respect to coal fired boilers which have taken on a new importance in the face of dwindling supplies of oil and natural gas type fuels. Extremely heavy deposits of soot, ash, or slag can accumulate on the interior walls of these furnaces producing very inefficient operation. The deposits can become so large and cumbersome that there is even a danger that they may fall off and physically damage the boiler.

In the prior art the standard solution to this problem has been to introduce through the furnace wall a large number of mechanically rotatable wall blowers sometimes called long-lance retracting blowers. A high pressure cleaning fluid such as steam, water, or air is directed through the lance onto the interior walls of the furnace in the hopes of blowing away the accumulated soot and ash. These mechanically rotated blowers have delicate mechanisms associated with them including a driving gear and the various seals that convey the cleaning fluid through the rotating joints. The lance cannot be left in the furnace for very long but must be retracted since it cannot endure the high operating temperatures therein. Accordingly, the lances are introduced on a periodic basis, for example, for a few minutes every hour or two and then withdrawn to protect the soot blower element. Many hundreds of these lances may be required over the extensive surface associated with power plant boilers which are physically quite huge and which must operate on a continuous basis. Thus, this method of cleaning is extremely expensive, prone to frequent malfunction and failure, and cumbersome to operate. Furthermore, the resultant cleaning is not completely satisfactory since it can only take place for a small time period every few hours.

SUMMARY OF THE INVENTION

In brief, our invention does away with all of the mechanical apparatus associated with rotating long lance blowers and utilizes a fluid dynamic system which comprises an improvement to the furnace cleaning system described in the copending patent application titled "Fluid Dynamic Furnace Cleaning System," filed by Richard J. Reilly on May 25, 1978 Jets of cleaning fluid are introduced through slots in the furnace walls just adjacent to the heat exchange tubes. When a fluid stream is directed tangentially to the heat exchange tube curved surface, it follows that surface and remains attached thereto. This results from the laws of fluid dynamics. The particular phenomonen is known as jet attachment. By designing the interior walls of the furnace with slots next to each of the tubes it is possible to blanket virtually the entire interior surface of the furnace with the cleaning fluid. The continuous scrubbing action keeps the surfaces much cleaner than the intermittent lance type blower known in the prior art. Accordingly, the transfer of energy is much more efficient and the furnace as a whole operates more efficiently. The system is, of course, much less expensive and much more maintenance free. Thus, it may be seen that it is an object of our invention to provide an improved furnace wall cleaning system. It is a further object of our invention to provide a furnace wall cleaning system utilizing fluid dynamic principles rather than mechanically movable parts. Further objects and advantages will become apparent on consideration of the following detailed description and drawings.

DESCRIPTION OF THE PREFERRED EMBODIMENT

Figure 1:
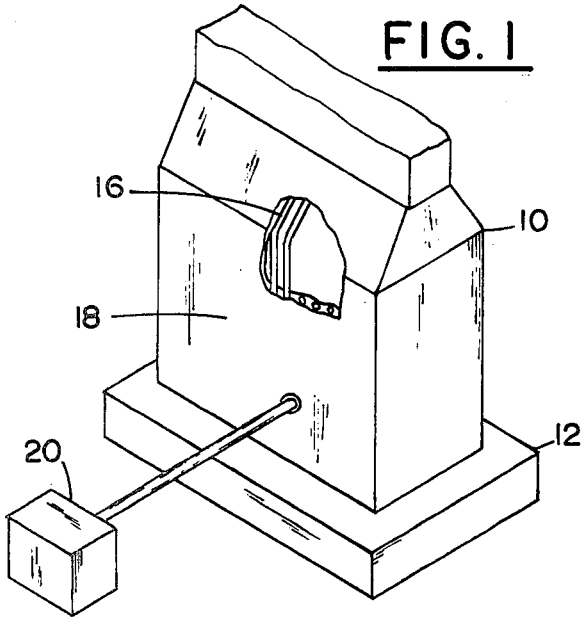
FIG. 1 is a partially cut away view of a boiler type furnace showing the steam tubes therein which are cleaned by our invention.

In FIG. 1 a boiler 10 is shown representing a typical design with a fire box 12 near the bottom and a plurality of steam tubes 14 in the walls which collect energy from the furnace and deliver it to turbines or other similar apparatus. In some cases, the steam tubes, which could, or course, use another heat transfer medium than water, are caused to bend inward near the top of the furnace, as shown at 16, in order to create a super heater section. Our invention comprises a suitable manifold 18 surrounding the furnace which directs air, or some other type of cleaning fluid, from a source of supply 20, past the steam tubes 14, and through slot shaped nozzles which are more completely shown in FIG. 2.

Figure 2:
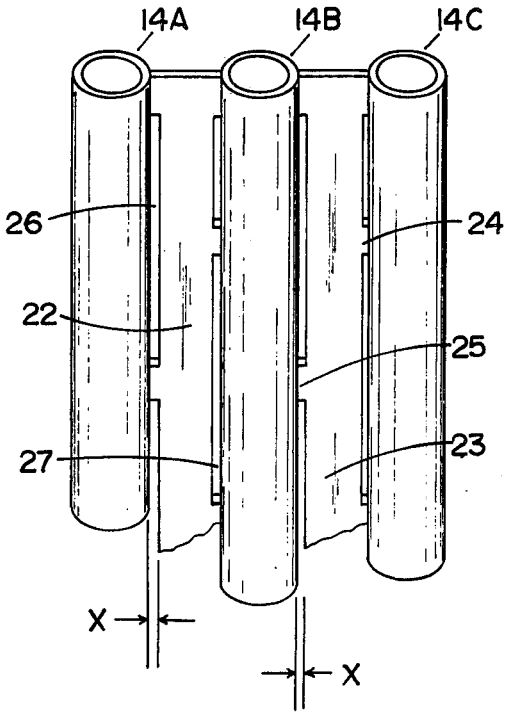
FIG. 2 is a greatly enlarged portion of the furnace wall showing the construction thereof with the fluid admission slots.

In FIG. 2 a very small segment of the furnace wall is shown wherein three of the steam tubes **14*a*, 14*b*, and 14*c* are connected together by suitable spacers 22 and 23. Small tabs 24 and 25 provide mounting points which could be, for example, welded to the sides of the steam tubes so as to leave a series of elongated narrow slots or nozzles 26 and 27. The width of these slots x, as shown in FIG. 2, could be typically about 20 thousandths of an inch although the exact size may vary depending upon how much cleaning fluid can pass from the supply manifold 18** into the furnace.

Figure 3:
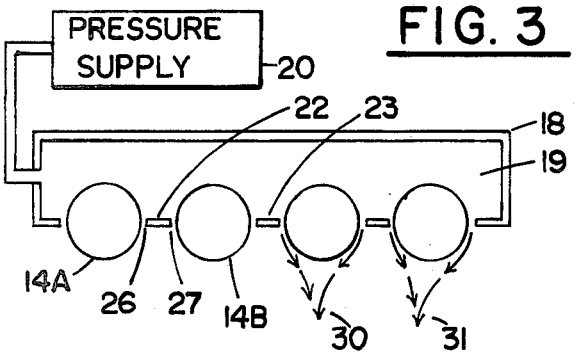
FIG. 3 is a schematic diagram of one embodiment of our invention utilizing a constant pressure supply.

In FIG. 3 the portion of the furnace wall described in FIG. 2 is rendered in a more schematic form to clarify the cleaning action which results from the nozzles 26 and 27. The cleaning fluid, which in the preferred embodiment is heated air so as to avoid a large temperature differential between the front and back sides of the steam tubes 14, is supplied by pressure supply 20 to a plenum chamber 19 in manifold 18. Plenum chamber 19 extends over most of the surface of the boiler but only a small portion is shown in FIG. 3. As the pressurized air in plenum chamber 19 escapes through nozzles 26 and 27, it follows the attachment surface formed by the steam tubes 14 which results in the course shown by the arrows 30 and 31. The entire surface of each steam tube 14 is continuously scrubbed and cleaned by the air stream from the nozzles.

In some situations it may be desirable to lessen the flow of air into the furnace to prevent the creation of an oxidizing atmosphere or to prevent interference with the furnace draft. In this case the air pressure in plenum chamber 19 can be oscillated to provide a series of small bursts separated by periods of less air flow. However, a more sophisticated approach for controlling the entry of air and simultaneously varying the cleaning and scrubbing action is shown in FIG. 4.

Figure 4:
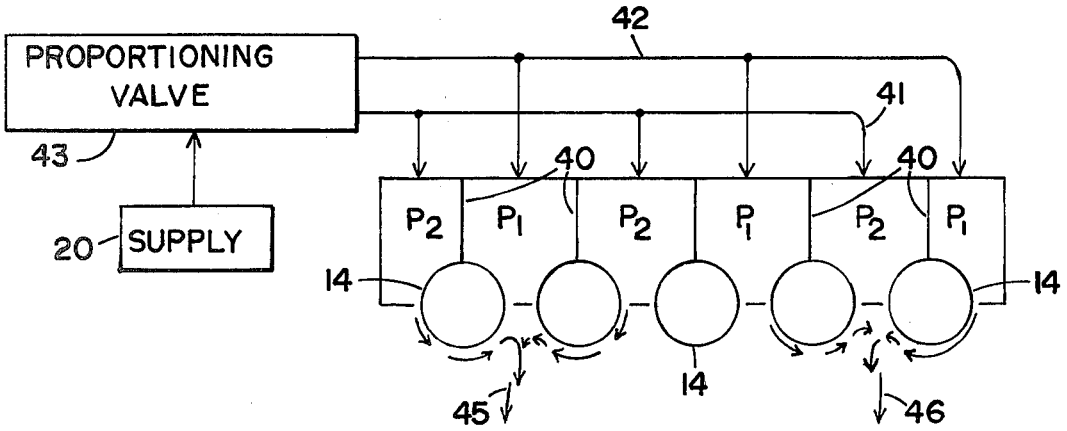
FIG. 4 is a schematic diagram of another embodiment of our invention utilizing a variable pressure supply to create a variable flow of the cleaning fluid over the furnace walls.

In FIG. 4 a section of furnace wall is shown in which additional dividers 40 create a plurality of segregated plenum chambers behind the steam tubes 14. Alternate plenum chambers are manifolded together by a system 41 to receive pressure P2. The remaining chambers are connected together by manifold 42 to receive a pressure P1. A proportioning valve 43 controls the flow of air making manifold 41 alternately higher and then lower in pressure relative to manifold 42. Valve 43 may be any mechanical type of valve well known to those skilled in the art or could comprise, for example, a fluid amplifier. When the pressure P2 is higher than the pressure P1 the flow follows the fluid attachment surfaces completely around the steam tubes 14 with the two streams joining together as shown at 45. However, when pressure P1 rises and exceeds the pressure P2, the flow of air reverses and follows the path 46 in an opposite direction along the attachment surfaces. This oscillation in pressure not only reduces the total flow of air into the furnace, but also alternately reverses the direction of flow of fluid across the tubes 14 to provide an even better scrubbing action. Obviously, a number of other variations in design could be effected as well utilizing different combinations of plenum chambers, different variations in air pressure, and different nozzle arrangements so as to provide complex and variable cleaning action on the interior surface of the furnace wall. Accordingly, we do not intend to be limited to the exact arrangements shown in the drawings except as defined by the appended claims.

We claim:

1. A fluid dynamic cleaning system for cleaning the heat transfer tubes on the inside surface of furnace walls comprising in combination:

interior furnace walls comprising a plurality of generally parallel heat transfer tubes and spacers between said tubes connecting the tubes together;

a cleaning fluid manifold on the furnace extending over the outside surface of said interior furnace walls;

supply means to supply a pressurized cleaning fluid to said manifold;

a plurality of entrance openings in the edges of said spacers in positions along the surfaces of the heat transfer tubes, said openings connected to said manifold so as to receive fluid therefrom and direct said fluid generally orthogonally to the length of the tubes and tangentially to the surface of the tubes, said heat transfer tubes having curved fluid attachment surfaces thereon operable to retain the flow of fluid thereacross.

2. The system of claim 1 including dividers in said manifold to form segregated plenum chambers, and in which said supply means is connected to the segregated plenum chambers through a variable pressure control so as to vary the flow of fluid across the tubes.

3. The system of claim 1 in which said spacers have intermittent connection points with said tubes so as to create openings along the sides of the tubes.

4. The system of claim 3 in which said openings comprise elongated slots parallel to the length of the tubes.

* * * * *